United States Patent [19]

Devine

[11] Patent Number: 4,570,686

[45] Date of Patent: Feb. 18, 1986

[54] APPARATUS FOR PREVENTING BLOCKAGE OF VAPOR RECOVERY HOSE BY LIQUID FUEL

[75] Inventor: George T. Devine, Greensboro, N.C.

[73] Assignee: Gilbarco Inc., Greensboro, N.C.

[21] Appl. No.: 507,488

[22] Filed: Jun. 24, 1983

[51] Int. Cl.[4] ..... B65B 1/04

[52] U.S. Cl. ..... 141/286; 141/392; 138/113; 138/114

[58] Field of Search ..... 138/113, 114, 148; 239/44, 45, 145; 141/392, 285-310, 1-12, 37-66; 220/373, 85 VR, 86 R

[56] References Cited

U.S. PATENT DOCUMENTS 4,121,623 10/1978 Rhone ..... 138/114
4,122,968 10/1978 Germain ..... 138/114
4,274,549 6/1981 Germain ..... 138/114

FOREIGN PATENT DOCUMENTS 2509258 9/1976 Fed. Rep. of Germany ..... 220/373

*Primary Examiner*—Houston S. Bell, Jr.
*Attorney, Agent, or Firm*—Kenneth Watov

[57] ABSTRACT

Wick material is included along the length of the interior and exterior walls of vapor recovery and product hoses, respectively, the product hose being carried within the length of the vapor recovery hose, whereby the wick material absorbs liquid entrapped between the hoses, and substantially increases the surface area of evaporation for the liquid, thereby substantially preventing liquid from blocking a portion of the vapor recovery path between the hoses.

20 Claims, 5 Drawing Figures

APPARATUS FOR PREVENTING BLOCKAGE OF VAPOR RECOVERY HOSE BY LIQUID FUEL

The field of the present invention relates generally to vapor recovery hoses, and more specifically to such hoses including liquid removal apparatus for maintaining an unblocked vapor recovery path.

In fluid distribution systems, such as gasoline pumping systems for delivering gasoline to the fuel tank of a vehicle, environmental protection laws require that vapors emitted by the fluid being distributed be recovered. One such vapor recovery system includes a vapor recovery hose surrounding a product hose for delivering fuel to a nozzle, typically the nozzle of a gasoline pump. Vapors developed at the nozzle end are sucked by vacuum pressure from the nozzle back into the gasoline storage tank of the product distribution system via the vapor return path provided by the space between the product and vapor recovery hoses. At times liquid fuel may overflow from the nozzle into the vapor recovery path of the vapor recovery hose and collect at a low point in the vapor recovery hose causing partial or total blockage of the return path for the vapors. Even partial blockage of the vapor recovery path of the hose must be avoided in order to insure that the product distribution system meets the environmental protection codes imposed by local, state and federal governments.

Various embodiments of the present invention substantially prevent blockage of the vapor path of a vapor recovery hose by including wicking means along the length of the interior of the vapor recovery hose for both absorbing entrapped fluid therein, and for substantially increasing the area of evaporation for the entrapped liquid or fluid.

Figure 1:
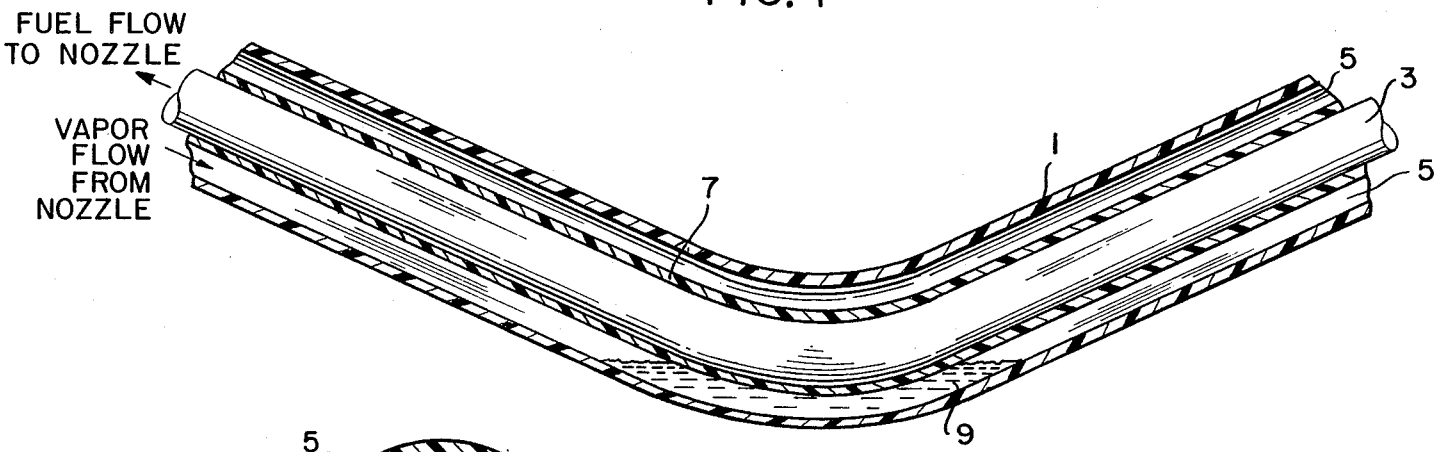
FIG. 1 is a sectional view taken along the longitudinal axis of a portion of a vapor recovery hose including a first embodiment of the invention.
Figure 2:
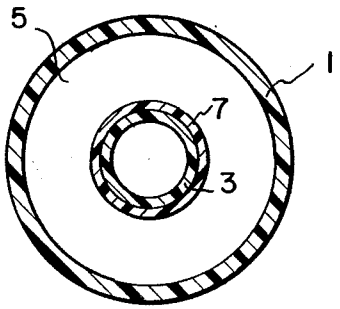
FIG. 2 is a cross sectional view taken perpendicular to the longitudinal axis of the vapor recovery hose of FIG. 1.

In FIG. 1, a cutaway pictorial view of the interior of a vapor recovery hose 1 which is enclosing or carrying within in its interior space a product hose 3 is shown. The space between the inside diameter of a vapor recovery hose 1 and the outside diameter or wall of the product hose 3 provides a vapor return path 5, for vapors that may develop at the end of the product hose 3 connected to a nozzle (not shown) for transferring a liquid such as gasoline to a tank, for example. A first embodiment of the invention includes a wick material 7 surrounding the product hose 3. The wick material 7 can be provided as a coating on the outside diameter of product hose 3, or provided as a sleeve through which the product hose 3 is inserted, or can be provided as a ribbon or tape that is wrapped around the outside of the product hose 3, for example. FIG. 2 shows a transverse cross section of the combination of the vapor recovery hose 1, product hose 3, and wick material 7. Note that the product hose 3 may not be always concentric with the axis of the vapor recovery hose 1 in practical applications.

Operation of the embodiment of the invention of FIG. 1 will now be described. In transferring a product such as gasoline through the product hose 3 to a fuel tank, overflows of fuel at the entry way to the fuel tank may cause some liquid fuel to enter the vapor recovery path 5 and collect at a low point in the vapor recovery hose 1 as shown, by the liquid 9 accumulated at the low point of the vapor recovery hose depicted in this example. The accumulated liquid fuel 9 may cause partial blockage of the vapor recovery path 5, as previously indicated. The wick material 7 acts to absorb the accumulated liquid 9, and to spread the absorbed liquid along the entire length of the wick material 7 about the product hose 3, thereby substantially increasing the area for evaporation of the liquid fuel. In this matter, accumulation of the liquid 9 at low points in the vapor recovery hose is substantially prevented. The wick material 7 acts to substantially reduce blockage of the vapor recovery path 5 by liquid fuel that enters the vapor path 5. A typical material for the wick 7 is naturally leached cotton.

Figure 3:
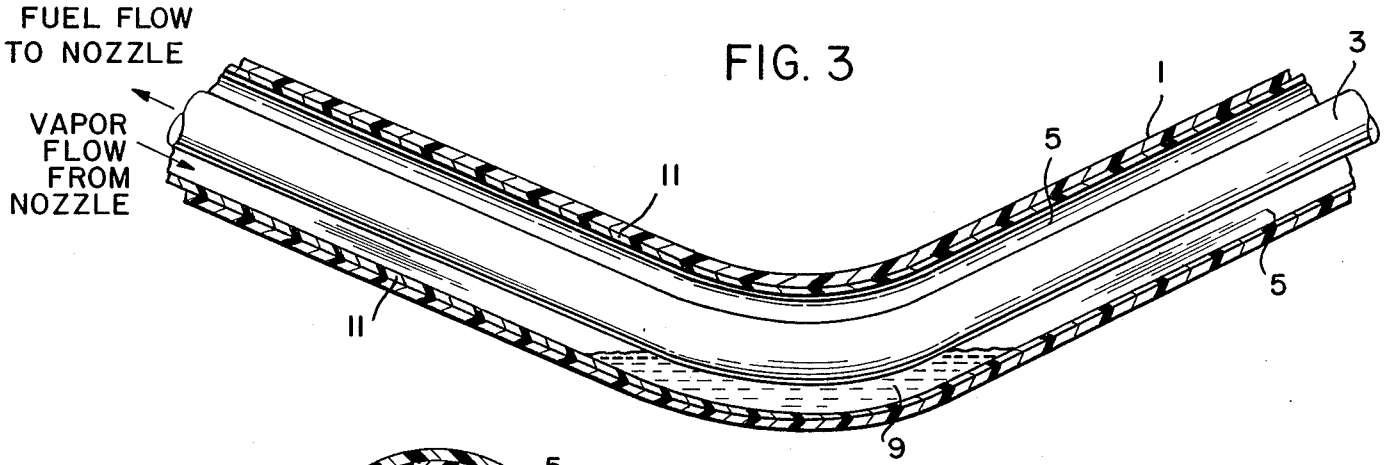
FIG. 3 is a sectional view taken along the longitudinal axis of a portion of a vapor recovery hose including a second embodiment of the invention.
Figure 4:
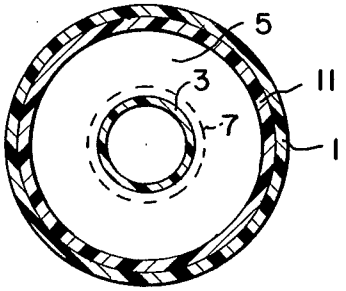
FIG. 4 is a cross sectional view taken perpendicular to the longitudinal axis of the vapor recovery hose of FIG. 3.

In FIG. 3, another embodiment of the invention is shown. In this embodiment wick material 11 is provided as a lining, or coating, for example, on the interior wall or inside diameter of the vapor recovery hose 1. The wick material 11 serves the same function as the wick material 7 shown in FIG. 1. A cross section of the embodiment of the invention of FIG. 3 is shown in FIG. 4. The first and second embodiments of the invention of FIGS. 1 and 3, can readily be combined to provide a vapor recovery system in which the vapor recovery hose 1 is lined with wick material 11, and the product delivery hose is coated or covered with a wick material 7, as shown in phanthom in FIG. 4. Note also in FIGS. 1 and 3, the directional arrows showing the typical directions of flow of fuel to a nozzle, and direction of flow of vapor return from the nozzle.

Figure 5:
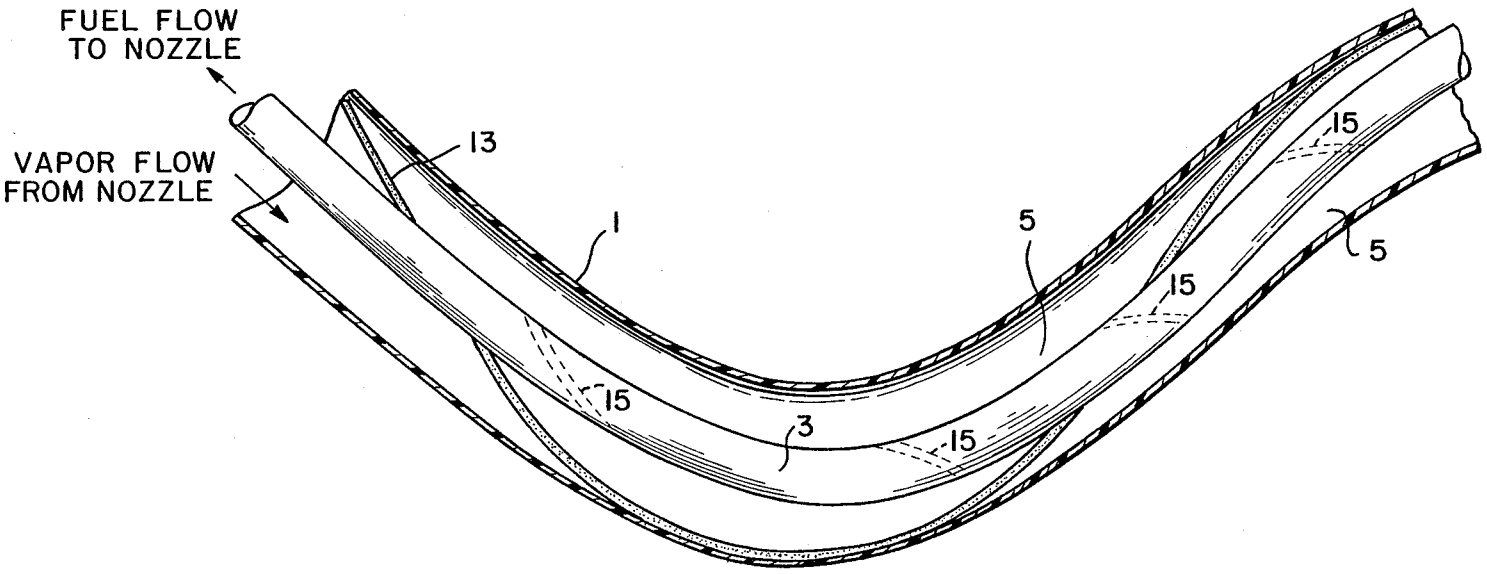
FIG. 5 is a sectional view taken along the longitudinal axis of a vapor recovery hose including other embodiments of the invention.

In FIG. 5, other embodiments of the invention are shown, wherein a tape or ribbon of wick material 13 is wound about the inside wall or diameter of the vapor recovery hose 1. Alternatively, a ribbon or tape or wick material 15 is wound about the product delivery hose 3 as shown in phanthom. Yet another alternative is to utilize ribbons or tapes of wick material 13 and 15 in combination as previously described.

Although particular embodiments of the invention have been shown and described, other embodiments and modifications of the invention will occur to those of ordinary skill in the art without departing from the true spirit and scope of the invention. For example, the various embodiments of the invention shown in FIGS. 1 through 5 may be used in many different combinations with one another. Also, the inventive use of the wick material is not limited to vapor recovery systems, and the invention is applicable for use for any system where liquid accumulation poses a problem. Examples of other systems where the present invention is useful are pressurized airlines, gas delivery pipelines, and so forth. Such systems may use single hoses for delivering a gas, for example, or twin hoses for delivering a liquid product in one hose and providing a vapor recovery hose with the other hose, and so forth. In addition, the wick material can be fabricated into the hose material during manufacture of the hose.

I claim

1. In a vapor recovery hose, apparatus for substantially preventing blockage of the vapor recovery path by liquid entrapped within the interior of said hose, comprising:

wicking means within the interior of said vapor recovery hose for both absorbing said liquid, and substantially increasing the surface area of evaporation for said liquid.

2. The apparatus of claim 1, wherein said wicking means includes a ribbon of wicking material wound about the inside wall of said hose along an extended length of said hose.

3. The apparatus of claim 1, wherein said wicking means includes wicking material forming a lining about the surface of the inside diameter of said hose along a substantial length of said hose.

4. The apparatus of claim 1, wherein said wicking means includes a sleeve of wick material concentric to the inside diameter of said hose.

5. The apparatus of claims 2, or 3, or 4, further including a product hose enclosed within the length of the interior of said vapor recovery hose.

6. The apparatus of claim 1, further including a product hose enclosed within the length of the interior of said vapor recovery hose, said wicking means being between the inside surface of said vapor recovery hose, and the outside surface of product hose.

7. The apparatus of claim 6, wherein said wicking means includes a ribbon of wicking material wrapped about a substantial length of the outside diameter of said product hose.

8. The apparatus of claim 6, wherein said wicking means includes a lining of wick material upon the outside diameter of said product hose.

9. The apparatus of claim 6, wherein said wicking means includes a sleeve of wick material enclosing a substantial portion of the length of said product hose.

10. The apparatus of claims 2, 3, 4, 8, or 9, wherein said wick material consists of naturally leached cotton.

11. The apparatus of claim 6, wherein said wicking means includes wicking material lining both the interior wall of said vapor recovery hose, and the outside wall of said product hose.

12. In a gasoline dispensing system, the combination comprising:

a vapor recovery hose;

a product hose enclose within the length of the interior of said vapor recovery hose; and wicking means within the space between the inside and outside walls of said vapor recovery and product hoses, respectively, for both absorbing liquid entrapped in said space, and substantially increasing the surface area of evaporation for the liquid, thereby substantially preventing blockage of a vapor recovery path formed by said space.

13. The gasoline dispensing system of claim 12, wherein said wicking means includes a ribbon of wick material wound about the interior wall of said vapor recovery hose.

14. The system of claim 12, wherein said wicking means includes a ribbon of wick material wound about the outside wall of said product hose.

15. The system of claim 12, wherein said wicking means includes ribbons of wick material wound about the inside walls of said vapor recovery and product hoses, respectively.

16. The system of claim 12, wherein said wicking means includes a sleeve of wick material juxtaposed along the length of the interior of wall said vapor recovery hose.

17. The system of claim 12, wherein said wicking means includes a sleeve of wick material covering the length of the outside wall of said product hose.

18. The system of claim 12, wherein said wicking means includes a first sleeve of wick material covering the length of the interior wall of said vapor recovery hose, and a second sleeve of wick material covering the outside wall of said product hose.

19. The system of claim 12, wherein said wicking means includes coatings of wick material upon the surfaces of the interior wall of said vapor recovery hose, and exterior wall of said product hose.

20. The system of claims 13, 14, 15, 16, 17, 18 or 19, wherein said wick material consists of naturally leached cotton.

* * * * *